US006008456A

United States Patent [19]

Pillmeier

[11] Patent Number: 6,008,456

[45] Date of Patent: Dec. 28, 1999

[54] LOAD SWITCH FOR A STEP SWITCH

[75] Inventor: Leonhard Pillmeier, Regensburg, Germany

[73] Assignee: Maschinenfabrik Reinhausen GmbH, Regensburg, Germany

[21] Appl. No.: 09/077,986

[22] PCT Filed: Dec. 5, 1996

[86] PCT No.: PCT/EP96/05432

§ 371 Date: Jun. 11, 1998

§ 102(e) Date: Jun. 11, 1998

[87] PCT Pub. No.: WO97/23888

PCT Pub. Date: Jul. 3, 1997

[30] Foreign Application Priority Data

Dec. 21, 1995 [DE] Germany ..... 195 47 873

[51] Int. Cl.[6] ..... H01H 21/18

[52] U.S. Cl. ..... 200/11 TC

[58] Field of Search ..... 200/11 TC, 1 V, 200/573, 337, 336, 564

[56] References Cited

U.S. PATENT DOCUMENTS 3,632,908 1/1972 Bleibtreu ..... 200/11 TC

FOREIGN PATENT DOCUMENTS 1613646 5/1971 Germany .

*Primary Examiner*—Renee S. Luebke
*Attorney, Agent, or Firm*—Herbert Dubno; Andrew Wilford

[57] ABSTRACT

A load switch has a housing, a pair of main contacts fixed in the housing, and a movable main contact pivotal on the housing between end positions in each of which it engages a respective one of the fixed contacts and through a middle position in which it engages neither of the fixed contacts. A central shaft extending along an axis and pivotal in both directions thereabout carries a cam having offset from the axis a cam formation. A mechanical link engaged between the cam formation and the movable contact can pivot it between its end positions and through its middle position on rotation of the cam about the axis.

5 Claims, 3 Drawing Sheets

LOAD SWITCH FOR A STEP SWITCH

CROSS REFERENCE TO RELATED APPLICATIONS

This application is the US national phase of PCT application PCT/EP96/05432 filed Dec. 5, 1996 with a claim to the priority of German application 195 47 873.8 filed Dec. 21, 1995.

FIELD OF THE INVENTION

The invention relates to a load switch with a load-free switching continuous main contact for a step switch of a step transformer wherein for each phase to be switch there is an electrically load-free switching continuous main contact pair, each continuous main contact pair consists of a fixed and movable continuous main contact, in each phase to be switched one of the two continuous main contact pairs is closed in the stationary condition and conducts continuous current such that at the start of a load switching the continuous main contact pair that was up to then conducting the main current opens and at the end of each switching operation the previously opened other continuous main contact pair closes and takes over the continuous current, and within the load switch there is a centrally extending switching shaft that for each load switching is alternately rotated in both directions through a predetermined angle.

BACKGROUND OF THE INVENTION

Such a load switch, as known from German patent 2,747,489 has for each of the phases to be switched respective auxiliary and main contact pairs which are moved with each switching one after the other. It further has for each phase to be switched two continuous main contact pairs, one contact pair of which conducts the main current in a stationary condition. The known load switch is formed as a cylinder; its housing is formed of cylindrical shells that carry the stationary main and auxiliary contacts. Arranged inside in sectors are the respective movable main and auxiliary contacts which are operated by a central switching shaft. Electrically parallel to the main contacts are respective load-free switching continuous current or continuous main contacts, the movable continuous main contacts being connected to the movable main contacts so as to be operated by them. It is known from German 1,930,719 that continuous main contacts connected to the respective main contacts are pivotal about a pin and biased by springs.

With the known load switch as described above the movable continuous main contacts are shifted together with the respective movable main contacts. Such a load switch is however principally intended only for carrying out such switching systems or switching sequences that are symmetrical, that is where independent of the switching direction and thus of the rotation direction of the switching shaft a fixed interval exists between the actuation of the main contacts and that of the respective continuous main contacts. In other words: with a symmetrical switching system with a reversed switching direction all the present main and auxiliary contacts are operated in the reversed order also.

Nonetheless so-called asymmetrical switching systems are known, for example from German 4,223,439 and WO 95/24724 which have electrical advantages and in particular are only logically usable when vacuum switches can be used as switching elements. With such asymmetrical switching systems the movement order of the individual main and auxiliary contacts is always the same; for example with the switching system known from WO 95/24724 in each switching direction the main contact moves before the auxiliary contact. The continuous main contacts that conduct the load current in the stationary condition must however open in any case even with asymmetrical switching systems as the first contact at the start of each load switching and as last contact at the end of each load switching. In other words, with such switching systems the actuation of the continuous main contacts remains symmetrical and that of the main and auxiliary contacts remains asymmetrical. This explains why the known load switch with a mechanical coupling of the continuous main contacts to the main contacts is not ideal for such switching systems.

OBJECT OF THE INVENTION

It is however an object of the invention to provide a load switch of this type wherein the actuation of the main and auxiliary contacts on the one hand and that of the main contacts are not coupled together.

SUMMARY OF THE INVENTION

This object is achieved according to the invention in a load switch of the above-described type but wherein a cam disk is mounted on the switching shaft and has for each phase to be switched a cam formation, and a roller engages each cam formation and is effective via a mechanical link on a movable continuous main contact such that it is pivotal regardless of the shape of the cam formation.

The main advantage of the invention is that, independent of the switching sequence and the actual position of the main contacts, an independent actuation of the continuous main contacts is possible directly by the switching shaft.

It is indeed known from German 1,930,719 and equivalent U.S. Pat. No. 3,632,908 to provide a load switch with arcuate slots in which roller bolts engage for actuating contacts. These slots are however parts of a rotatable and shiftable switching segment that is a separate part; they actuate the main and auxiliary contacts and this solution contributes nothing to an uncoupled actuation of the continuous main contacts.

From German 1,805,378 it is further known to control a switch by a double disk with an upper and a confronting lower cam that are not both geometrically identical. The two cams are offset with this known solution relative to each other and lie only at their ends over one another. In addition the upper disk is provided with blocking segments that latch when operated by a pawl. Between the upper disk and the lower disk there is a bolt provided with two rollers that is set up such that it can engage in the upper cam and also in the lower cam. This arrangement serves nonetheless for actuating a resistance switch whose basic connection is with an overswitching resistor. This solution suggests nothing with respect to a uncoupled actuation of the continuous main contacts. In addition the necessary interaction between the two different curves necessitates considerable manufacturing costs.

BRIEF DESCRIPTION OF THE DRAWING

The invention is more closely described by way of example in the following with reference to the drawings.

Therein.

SPECIFIC DESCRIPTION

Figure 1:
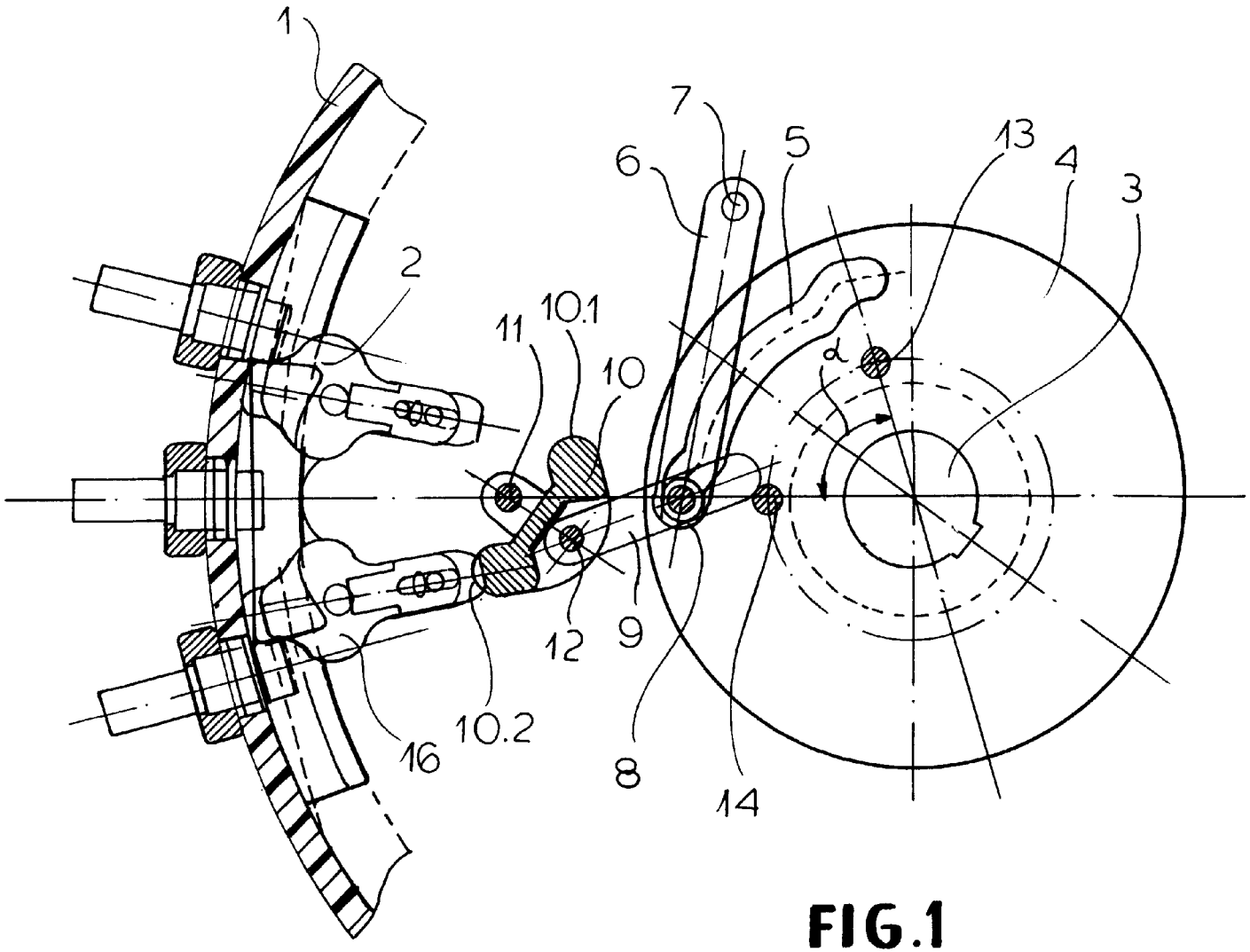
FIG. 1 is a load switch according to the invention in a schematic sectional view from above only showing the continuous main contacts and means for moving them.

The load switch according to the invention is mounted inside an insulating cylinder 1 in whose center is mounted a vertical switching shaft 3 that as is known with each load switching is turned by an unillustrated force-storage unit in both directions through a predetermined angle α. Fixed continuous main contacts 2 and 16 project into the interior of the insulating cylinder 1. A cam disk 4 that has for each phase to be actuated a cam formation 5 is fixed on the switching shaft 3. A roller 8 engages the cam formation 5. The pin in the center of the roller 8 functions as the pivot 15 for two further parts that are thus connected together for joint movement: With the free end of a rocker 6 that is pivotal about a pivot 7 and with the free end of a lever 9 that again is pivoted at a further pivot 12. The pivot 12 again is arranged on a movable continuous main contact 10. This movable continuous main contact 10 is formed so that it is pivotal about a further pivot 11 and has two contact surfaces 10.1 and 10.2 that move into contact with one of the two fixed continuous main contacts 2 and 16 when pivoting into one of the two end positions. In the (neutral) central position of the movable continuous main contact 10 on the other hand there is no contact. The current feed to the movable continuous main contact 10 is not shown here. Similarly the main and auxiliary contacts of the load switch are not shown in detail.

Figure 3:
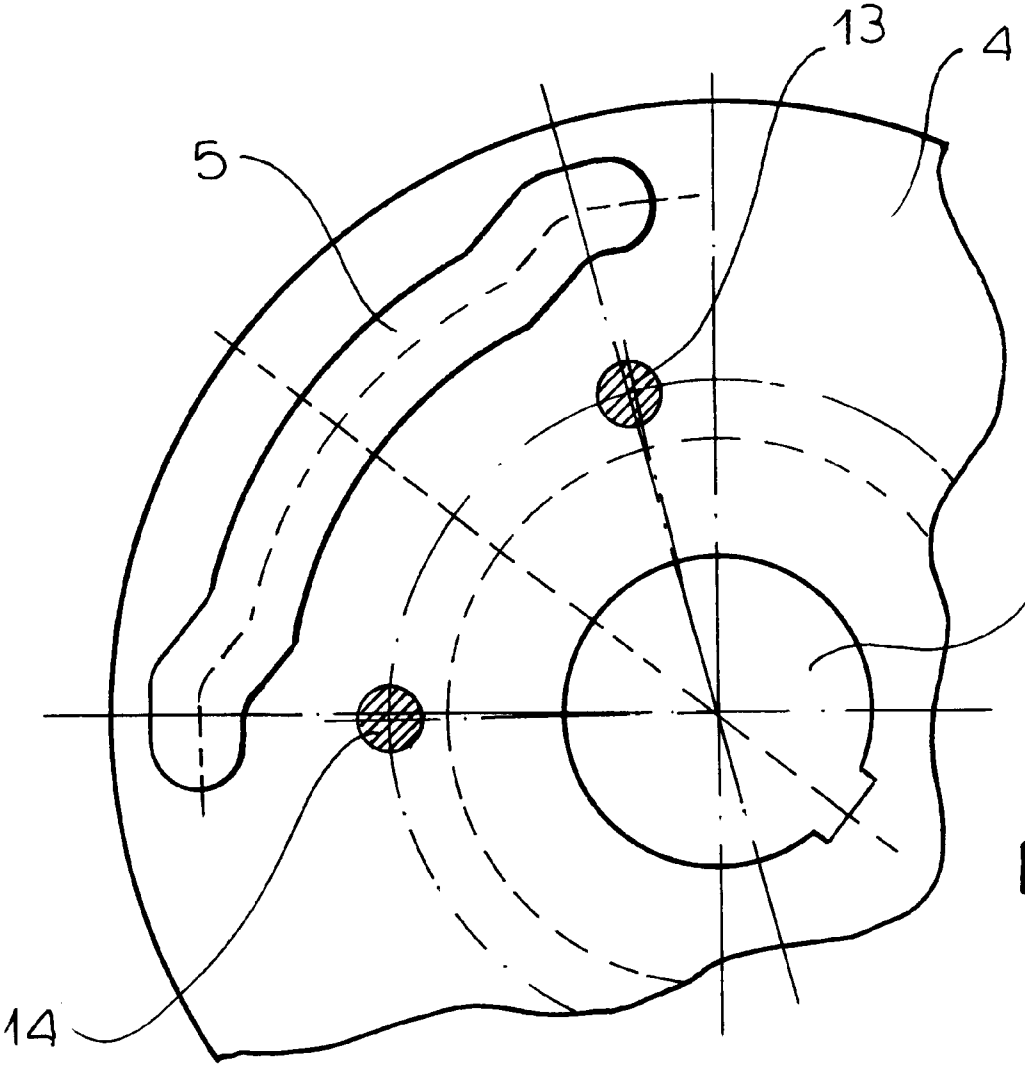
FIG. 3 is a portion of a cam disk with a single cam formation.

FIG. 3 shows a cam formation 5 in detail. It is clear that the shape generally follows in a central region a concentric circular arc and near the end positions has a larger radial distance from the switching shaft 3. The end positions thus correspond to the two possible positions in stationary condition.

The operation of the load switch according to the invention is more closely described in the following. If the load switching is triggered the switching shaft 3 starts to turn, for example counterclockwise. This also rotates the cam 4; the roller 8 riding in the cam formation 5 swings the rocker 6 about its pivot 7. This moves the lever 9 which in turn rotates the movable continuous main contact 10 about the pivot 11 and into its central position. The movable continuous main contact 10 leaves the previous fixed continuous main contact 16 and goes into the neutral center position. On further rotation of the switching shaft 3 the unillustrated main and auxiliary contacts are actuated in the order necessary for the switching and the movable continuous main contact 10 meanwhile stays in the center position. Shortly before reaching the end position the relative position of the roller 8 changes again as a result of its riding in the cam formation 5, the rocker 6 is again pivoted, the lever 9 pivots, and the movable continuous main contact 10 engages the other fixed continuous main contact 2 and takes over the load current; the switching operation is thus complete.

The cam disk 4 has a left abutment 13 and a right abutment 14 whose positions are so set relative to the lever 9 that according to rotation direction they engage on rotation of the cam 4 on one side of the lever 9 and thus clearly follow its pivoting direction and thus establish the movement direction of the movable continuous main contact 10 as preferred direction. This ensures that starting from the middle position the roller 8 alternately goes to the opposite end position of the cam formation and thus the movable continuous main contact 10 is alternately switched between the fixed continuous main contacts 2 and 16.

Figure 2:
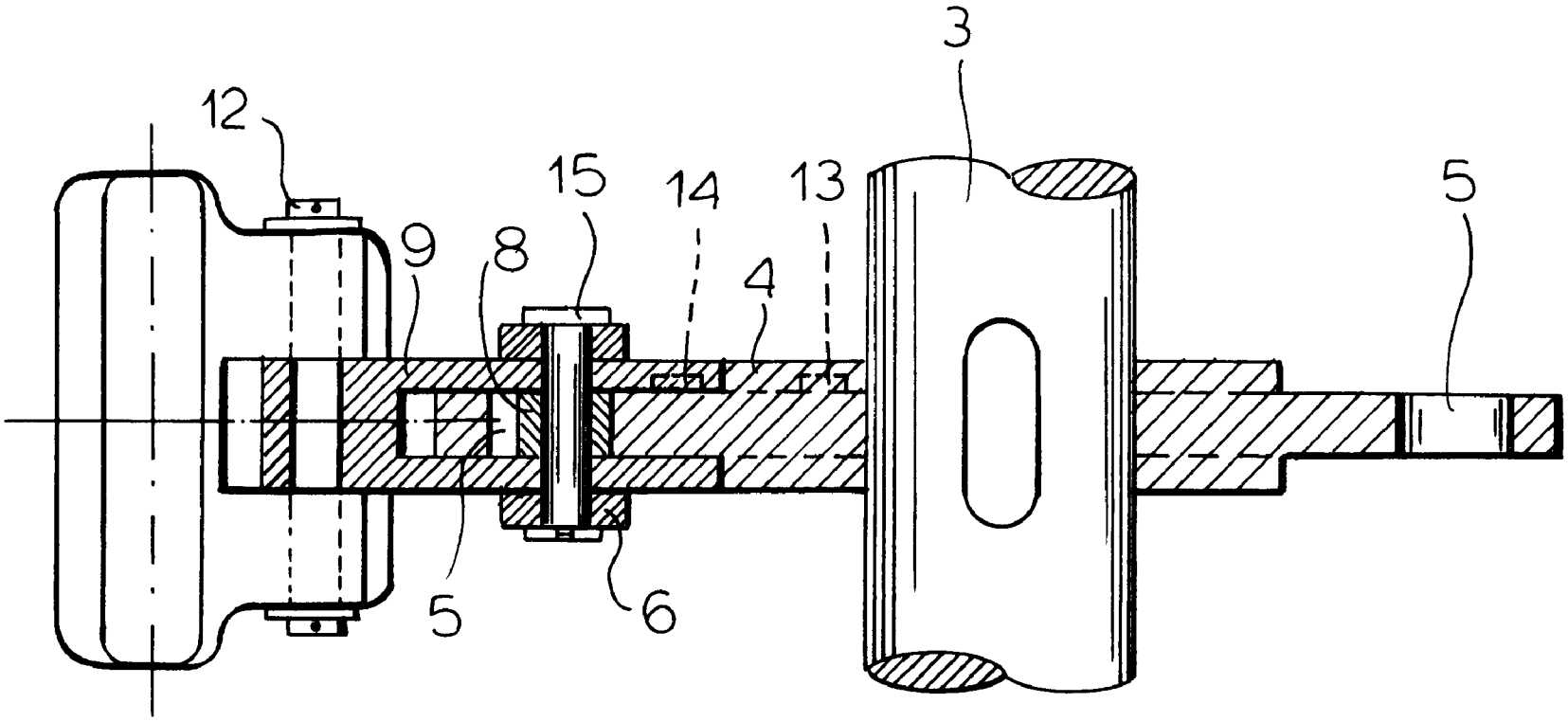
FIG. 2 is this load switch which also is shown in a schematic sectional side view.

As already described FIGS. 1 to 3 show and describe the overall arrangement for actuating the continuous main contacts for only one phase. In a standard three-phase arrangement of the load switch the cam disk 4 is provided with three identically shaped cam formations, three complete arrangements for actuating the respective continuous main contacts are angularly distributed about the switching shaft 3.

I claim:

1. A load switch comprising:

a housing;

a pair of main contacts fixed in the housing;

a movable main contact pivotal on the housing between end positions in each of which it engages a respective one of the fixed contacts and through a middle position in which it engages neither of the fixed contacts;

a central shaft extending along an axis and pivotal in both directions thereabout;

a cam fixed on the shaft and having offset from the axis a cam formation;

means including a mechanical link engaged between the cam formation and the movable contact for pivoting it between its end positions and through its middle position on rotation of the cam about the axis; and a rocker having one end pivoted on the housing and an opposite end pivoted on the link, the link having one end pivoted at the opposite rocker end on the cam formation and an opposite end pivoted on the movable main contact.

2. The load switch defined in claim 1 wherein the movable main contact has a central pivot on the housing and a pair of ends respectively engageable with the fixed main contacts.

3. A load switch comprising:

a housing;

a pair of main contacts fixed in the housing;

a movable main contact pivotal on the housing between end positions in each of which it engages a respective one of the fixed contacts and through a middle position in which it engages neither of the fixed contacts;

a central shaft extending along an axis and pivotal in both directions thereabout;

a cam fixed on the shaft and having offset from the axis a cam formation in turn having an arcuate central section centered on the axis and a pair of end sections each spaced radially farther from the axis than the center section; and means including a mechanical link engaged between the cam formation and the movable contact for pivoting it between its end positions and through its middle position on rotation of the cam about the axis.

4. The load switch defined in claim 3 wherein the means further includes a rocker having one end pivoted on the housing and an opposite end pivoted on the link, the link having one end pivoted at the opposite rocker end on the cam formation and an opposite end pivoted on the movable main contact.

5. A load switch comprising:

a housing;

a pair of main contacts fixed in the housing;

a movable main contact pivotal on the housing between end positions in each of which it engages a respective one of the fixed contacts and through a middle position in which it engages neither of the fixed contacts;

a central shaft extending along an axis and pivotal in both directions thereabout;

a cam fixed on the shaft and having offset from the axis a cam formation;

means including a mechanical link engaged between the cam formation and the movable contact for pivoting it between its end positions and through its middle position on rotation of the cam about the axis; and a pair of end abutments on the cam engageable with the link in positions corresponding to the end positions of the movable main contact and urging the link angularly of the axis in respective opposite directions.

* * * * *